US008306243B2

(12) United States Patent
Kimura et al.

(10) Patent No.: US 8,306,243 B2
(45) Date of Patent: Nov. 6, 2012

(54) AUDIO DEVICE

(75) Inventors: Masaru Kimura, Tokyo (JP); Bunkei Matsuoka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 560 days.

(21) Appl. No.: 12/663,684

(22) PCT Filed: Aug. 11, 2008

(86) PCT No.: PCT/JP2008/002193

§ 371 (c)(1),
(2), (4) Date: Dec. 8, 2009

(87) PCT Pub. No.: WO2009/022463

PCT Pub. Date: Feb. 19, 2009

(65) Prior Publication Data

US 2010/0172505 A1 Jul. 8, 2010

(30) Foreign Application Priority Data

Aug. 13, 2007 (JP) ..... 2007-211018

(51) Int. Cl.
*H04R 1/40* (2006.01)
*H04R 5/00* (2006.01)

(52) U.S. Cl. ..... 381/97; 381/1; 381/17

(58) Field of Classification Search ..... 381/97, 381/98, 1, 17–20, 27, 309, 310
See application file for complete search history.

(56) References Cited

U.S. PATENT DOCUMENTS

| | | | | |
|---|---|---|---|---|
| 4,239,937 | A * | 12/1980 | Kampmann | 381/28 |
| 4,975,954 | A | 12/1990 | Cooper et al. | |
| 5,414,774 | A * | 5/1995 | Yumoto | 381/1 |
| 5,862,228 | A * | 1/1999 | Davis | 381/17 |
| 5,974,153 | A * | 10/1999 | Cashion et al. | 381/11 |
| 6,091,894 | A | 7/2000 | Fujita et al. | |
| 7,242,782 | B1 * | 7/2007 | Kasai et al. | 381/97 |
| 7,492,906 | B2 * | 2/2009 | Matsuoka et al. | 381/17 |
| 7,702,111 | B2 * | 4/2010 | Gunnarsson | 381/1 |
| 8,085,950 | B2 * | 12/2011 | Suzuki | 381/97 |

(Continued)

FOREIGN PATENT DOCUMENTS

JP 7-46700 A 2/1995

(Continued)

OTHER PUBLICATIONS

Juro Ohga et al., "Acoustic System and Digital Processing", The Institute of Electronics, Information and Communication Engineers (IEICE), Corona Publishing, Co., Ltd., Mar. 1995, pp. 233-237.

*Primary Examiner* — Xu Mei
(74) *Attorney, Agent, or Firm* — Birch, Stewart, Kolasch & Birch, LLP

(57) ABSTRACT

A signal processing section 3 is set up which provides an anti-phase component signal S extracted by an anti-phase component extracting section 2 with a transfer characteristic $(H_d+H_x)/(H_d-H_x)$; an adder 4 adds the phase-inverted signal of the anti-phase component signal S provided with the transfer characteristic by the signal processing section 3 and an in-phase component signal M extracted by an in-phase component extracting section 1; and an adder 5 adds the anti-phase component signal S provided with the transfer characteristic by the signal processing section 3 and the in-phase component signal M extracted by the in-phase component extracting section 1.

8 Claims, 9 Drawing Sheets

U.S. PATENT DOCUMENTS

| | | | | |
|---|---|---|---|---|
| 2004/0170281 | A1* | 9/2004 | Nelson et al. | 381/17 |
| 2005/0220312 | A1 | 10/2005 | Kasai et al. | |
| 2007/0189551 | A1* | 8/2007 | Kimijima | 381/97 |
| 2011/0064243 | A1* | 3/2011 | Katayama et al. | 381/97 |
| 2011/0293111 | A1* | 12/2011 | Chang et al. | 381/97 |

FOREIGN PATENT DOCUMENTS

| | | | |
|---|---|---|---|
| JP | 2000-50399 | A | 2/2000 |
| JP | 2000-506691 | A | 5/2000 |
| WO | WO-97/30566 | A1 | 8/1997 |

* cited by examiner

AUDIO DEVICE

TECHNICAL FIELD

The present invention relates to an audio device capable of achieving virtual acoustic image localization at any desired position using sounds reproduced from speakers.

BACKGROUND ART

Conventionally, an audio reproduction technique (referred to as "virtual acoustic image localization technique" from now on) has been known which uses only two speakers, and has a listener perceive as if a sound source were present at any desired position in space.

A method of carrying out the virtual acoustic image localization technique is shown in the following Non-Patent Document 1, for example. FIG. 9 shows a configuration thereof.

According to Non-Patent Document 1, the virtual acoustic image localization technique measures (or estimates) a transfer characteristic from a desired position in a space to ears of a person at any desired position in the same space in advance, and generates signals considered to reach the ears by a convolution of the transfer characteristic into an input sound source.

The signals thus generated are called "binaural signals", and can make a listener feel as if the sound source were present at any given position by providing the binaural signals to the ears using a reproduction device such as headphones.

However, when the reproduction device is speakers, the following cross-talk cancellation processing becomes necessary to bring the binaural signals to the ears properly.

For example, in the speaker reproduction, if the signal to be provided to a first ear (right ear, for example) is reproduced with a first speaker (right speaker, for example) directly, "crosstalk" will occur in which the sounds produced from the right speaker reach not only to the right ear via a space transfer function G11, but to the left ear via the space transfer function G12, thereby being unable to provide the binaural signals to both ears properly.

In the case of being unable to provide the binaural signals to both ears properly, a problem occurs in that the acoustic image is not localized at a target position.

To solve the problem, the virtual acoustic image localization technique based on the speaker reproduction generally carries out cross-talk cancellation processing to suppress the crosstalk.

As for the example shown in FIG. 9, it carries out cross-talk cancellation processing using filters H11, H12, H21 and H22 so that audio signals z1 and z2 received by the listener's ears agree with dummy head outputs x1 and x2. This makes it possible to provide the right and left binaural signals accurately.

However, the foregoing cross-talk cancellation processing often causes deterioration in the sound quality because center-localized components (such as speech or vocal components) to be localized at the center are perceived to be pulled back, and hence cannot be heard clearly or are perceived as having echoes.

In addition, since it weakens low frequency components, it detracts impressive low frequency feeling.

Here, as for the center-localized components and low frequency components, in-phase components are dominant in both of them. In the following, a reason why the in-phase components are dominant will be described.

When generating the binaural signals for causing a particular sound source to be localized at the center, it is natural that the binaural signals are generated on the assumption that the sound source is placed in front of the listener.

When the sound source is placed in front of the listener, the sounds will arrive at the left ear and right ear of the listener almost at the same time. This can be understood from a reason that since a human face is almost symmetrical, the transfer characteristic from the frontal sound source position to the right ear is nearly equal to the transfer characteristic from the frontal sound source position to the left ear.

Not only in the binaural signals, but also in an ordinary stereo sound source, the center-localized components are recorded in a nearly right and left in-phase manner.

Accordingly, in the binaural signals and ordinary stereo signals, the in-phase components are dominant in the center-localized components. There are many cases where they are completely in-phase signals.

Next, when generating binaural signals that will cause a sound source to be localized at a 90-degree right side of a listener, the binaural signals are generated on the assumption that the sound source is placed at a 90-degree right side of the listener.

When the sound source is placed at the 90-degree right side of the listener, sounds will arrive at the right ear, first, and then at the left ear with a delay corresponding to the width of the face (difference in distance between the right and left ears).

It is known that a low frequency component is apt to diffract in comparison with middle to high frequency components. Thus, sounds with their amplitude intensity being little attenuated as compared with the sounds arriving at the right ear bend around and arrive at the left ear, as well.

In other words, the binaural signals become signals in which the signal for the right ear is output first, and then the signal for the left ear is output after a fixed time period. As for the low frequency components, the amplitude intensity difference between the right and left is small.

Here, the fixed time period, which is a delay time of a sound wave of about the face width, corresponds to the delay time of about 20-30 samples in a DVD audio signal sampled at 48000 Hz, for example.

Consider the case where the low frequency signal is 100 Hz or less. Then, its wavelength becomes 480 samples or more for one period.

Accordingly, even if delaying the low frequency signal of 100 Hz by 30 samples corresponding to the delay time of the face width, its phase is delayed only $1/16\lambda$ or less (where $\lambda$ is a wavelength), which can be considered to be almost an in-phase signal without any problem.

At angles other than the right side 90 degrees, it is natural that the phase delays at the right and left become smaller than that.

Thus, as for the binaural signals, the low frequency components can be considered nearly in-phase components. In ordinary stereo sources, although the low frequency components are sometimes recorded while providing amplitude difference between the right and left, they are usually recorded as nearly in-phase components.

For the foregoing reasons, as for the center-localized components and low frequency components, the in-phase components are dominant in both of them.

Here, a case where in-phase component signals are input to the foregoing cross-talk cancellation processing will be described.

FIG. 10 shows diagrams illustrating time responses of signals output from the audio device when the in-phase component signals are input to the cross-talk cancellation processing.

Here, they are schematic diagrams when approximating a transfer characteristic $H_d$ by impulses and when approximating a transfer characteristic $H_x$ by impulses involving delay and attenuation. Even if such approximation is not made, a rough inclination of the time response is the same.

When the in-phase components are input, the output signals of the audio device have the same time response for the right and left as shown in FIG. 10: Their signs are inverted at fixed time intervals, and the response continues with attenuation.

In FIG. 10, each positive side impulse at time zero (see (a)) is a component arriving at an ear closer to the speaker, and the entire response portion following (a) (see (b)) operates as a signal for cancellation.

About the ears of the listener sitting at the position supposed in the design stage of the cross-talk cancellation processing (referred to as "standard position" from now on), the response portions (b) cancel out each other, and the crosstalk is canceled completely.

However, when the listener shifts from the standard position even slightly, the response portions (b) do not cancel out each other so that the listener perceives deterioration in the sound quality with echoes.

In an actual listening environment, a listener is seldom sitting at the standard position so that in many cases the center-localized component signals have echoes. Thus, the acoustic image is pulled back, and the sound quality deteriorates as well.

FIG. 11 is a diagram showing a result of the frequency analysis of FIG. 10.

The frequency characteristics of the output signals of the cross-talk cancellation processing to which the in-phase components are input have a peak in a middle range component of about 1000 Hz-3000 Hz as shown in FIG. 11. Thus, it is found that the low frequency component is greatly attenuated compared with the peak portion.

It is found in FIG. 11 that the low frequency signal of 100 Hz is attenuated by about 18 dB as compared with the middle to high frequency signal of 2000 Hz.

As described above, in the conventional cross-talk cancellation processing, the center-localized components are pulled back theoretically, which causes the sound quality deterioration such as provided with echoes and the sound quality deterioration such as a weakened low frequency signal.

Besides the cross-talk cancellation processing disclosed in Non-Patent Document 1, the cross-talk cancellation processing is disclosed in the following Patent Documents 1 and 2, for example.

However, since the cross-talk cancellation processing operates in the completely same trend when the in-phase signals are input, the center-localized components are pulled back theoretically, which causes the sound quality deterioration such as provided with echoes and the sound quality deterioration such as a weakened low frequency signal.

Non-Patent Document 1: "Acoustic System and Digital Processing", Corona Publishing Co., Ltd., March 1995, p. 233-p. 237.

Patent Document 1: Japanese Patent Laid-Open No. 2000-506691.

Patent Document 2: Japanese Patent Laid-Open No. 7-46700/1995.

With the foregoing configuration, the conventional audio device can bring, when the reproduction device is speakers, the binaural signals to the ears properly by carrying out the cross-talk cancellation processing. However, it has a problem of bringing about the sound quality deterioration of the center-localized components or low frequency components.

The present invention is implemented to solve the foregoing problem. Therefore it is an object of the present invention to provide an audio device capable of achieving good quality cross-talk cancellation processing which does not bring about the sound quality deterioration of the center-localized components or low frequency components.

DISCLOSURE OF THE INVENTION

An audio device in accordance with the present invention is configured in such a manner that it includes a signal processing means for providing an anti-phase component signal extracted by an anti-phase component extracting means with a transfer characteristic for canceling a crosstalk component, and that a first adding means adds the phase-inverted signal of the anti-phase component signal which is provided with the transfer characteristic for canceling the crosstalk component by the signal processing means and an in-phase component signal extracted by an in-phase component extracting means, and a second adding means adds the anti-phase component signal which is provided with the transfer characteristic for canceling the crosstalk component by the signal processing means and the in-phase component signal extracted by the in-phase component extracting means.

According to the present invention, since the audio device in accordance with the present invention is configured in such a manner that it includes a signal processing means for providing an anti-phase component signal extracted by the anti-phase component extracting means with a transfer characteristic for canceling a crosstalk component, and that a first adding means adds the phase-inverted signal of the anti-phase component signal which is provided with the transfer characteristic for canceling the crosstalk component by the signal processing means and an in-phase component signal extracted by an in-phase component extracting means, and a second adding means adds the anti-phase component signal which is provided with the transfer characteristic for canceling the crosstalk component by the signal processing means and the in-phase component signal extracted by the in-phase component extracting means, it offers an advantage of being able to achieve good quality cross-talk cancellation processing without bringing about sound quality deterioration of a center-localized component or low frequency component.

BEST MODE FOR CARRYING OUT THE INVENTION

The best mode for carrying out the invention will now be described with reference to the accompanying drawings to explain the present invention in more detail.

Embodiment 1

Figure 1:
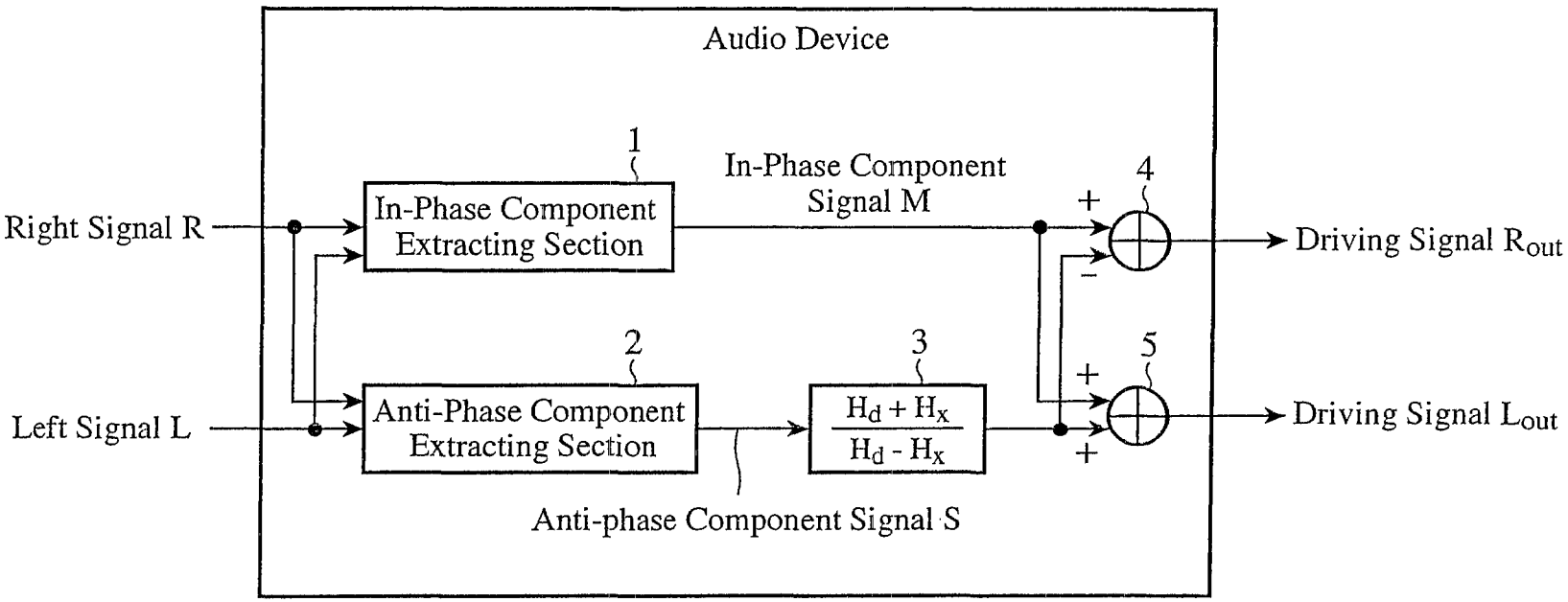
FIG. 1 is a block diagram showing a configuration of an audio device of the embodiment 1 in accordance with the present invention.

FIG. 1 is a block diagram showing a configuration of an audio device of an embodiment 1 in accordance with the present invention. In FIG. 1, an in-phase component extracting section 1 receives the right signal R and left signal L of an audio signal, and carries out processing of extracting an in-phase component signal M of the right signal R and left signal L. Incidentally, the in-phase component extracting section 1 constitutes an in-phase component extracting means.

An anti-phase component extracting section 2 receives the right signal R and left signal L of the audio signal, and carries out processing of extracting the anti-phase component signal S of the right signal R and left signal L. Incidentally, the anti-phase component extracting section 2 constitutes an anti-phase component extracting means.

As for the right signal R and left signal L of the audio signal received by the in-phase component extracting section 1 and anti-phase component extracting section 2, although they are preferably binaural signals, they are not limited to them. For example, any audio signals such as a signal output from a CD player or DVD player, a broadcast voice signal received with a DTV receiver, and a signal obtained by A/D converting an analog audio signal can become an object.

A signal processing section 3 carries out processing of providing the anti-phase component signal S extracted by the anti-phase component extracting section 2 with a transfer characteristic used for crosstalk component cancellation. More specifically, when the transfer characteristic for the sound which is reproduced from a speaker on one side (right speaker, for example) of the stereo speakers and arrives at the listener's ear on the same side as the speaker on the one side (right ear, for example), is represented by $H_d$, and the transfer characteristic for the sound which is reproduced from the speaker on the one side and arrives at the listener's ear on the other side of the speaker on the one side (left ear, for example), is represented by $H_x$, it carries out the processing of providing the anti-phase component signal S extracted by the anti-phase component extracting section 2 with the transfer characteristic $(H_d+H_x)/(H_d-H_x)$. Incidentally, the signal processing section 3 constitutes a signal processing means.

An adder 4 adds the phase-inverted signal of the anti-phase component signal S, to which the transfer characteristic $(H_d+H_x)/(H_d-H_x)$ is provided by the signal processing section 3, and the in-phase component signal M extracted by the in-phase component extracting section 1, and carries out processing of outputting the sum signal of the phase-inverted signal of the anti-phase component signal S and the in-phase component signal M as a driving signal $R_{out}$ of the right speaker. Incidentally, the adder 4 constitutes a first adding means.

An adder 5 adds the anti-phase component signal S, to which the transfer characteristic $(H_d+H_x)/(H_d-H_x)$ is provided by the signal processing section 3, and the in-phase component signal M extracted by the in-phase component extracting section 1, and carries out processing of outputting the sum signal of the anti-phase component signal S and the in-phase component signal M as a driving signal $L_{out}$ of the left speaker. Incidentally, the adder 5 constitutes a second adding means.

Figure 2:
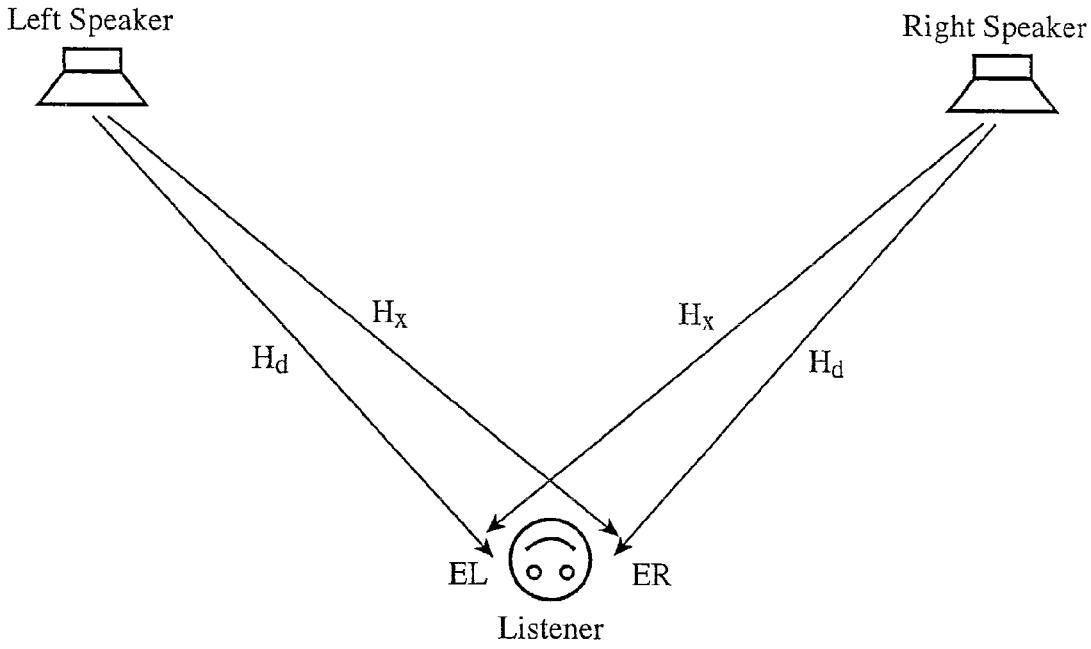
FIG. 2 is a diagram showing relationships among speakers and the position of a listener and transfer characteristics.

FIG. 2 is a diagram showing relationships among the speakers and the position of the listener and the transfer characteristics.

In FIG. 2, ER designates sounds arriving at the listener's right ear from the right and left speakers, and EL designates sounds arriving at the listener's left ear from the right and left speakers.

Next, the operation will be described.

The right signal R and left signal L of the audio signal are bifurcated when they are input to the audio device, and are input to the in-phase component extracting section 1 and to the anti-phase component extracting section 2.

The in-phase component extracting section 1, receiving the right signal R and left signal L of the audio signal, extracts the in-phase component signal M of the right signal R and left signal L.

Here, as a method for the in-phase component extracting section 1 to extract the in-phase component signal M of the right signal R and left signal L, a method is conceivable which adds the right signal R and left signal L, and extracts the result of the addition as the in-phase component signal M, for example. The method is characterized by a low operation cost.

It is assumed here that the present embodiment 1 employs the method of extracting the in-phase component signal M by adding the right signal R and the left signal L, but it is not limited to the method. For example, it can also employ a method of extracting the in-phase component signal M using an adaptive digital filter.

More specifically, assume that the adaptive digital filter employs the right signal R as the input signal and the left signal L as the target signal of the adaptive digital filter (the input signal and the target signal are interchangeable), then it learns filter coefficients adaptively, and uses the output signal from the adaptive digital filter as the in-phase component signal M.

Besides, any extracting method of the in-phase component signal can be employed.

The anti-phase component extracting section 2, receiving the right signal R and left signal L of the audio signal, extracts the anti-phase component signal S of the right signal R and left signal L.

Here, as a method for the anti-phase component extracting section 2 to extract the anti-phase component signal S of the right signal R and left signal L, a method is conceivable which subtracts the right signal R from the left signal L (the left signal L and right signal R are interchangeable), and extracts the result of the subtraction as the anti-phase component signal S, for example. The method is characterized by a low operation cost.

It is assumed here that the present embodiment 1 employs the method of extracting the anti-phase component signal S by subtracting the right signal R from the left signal L, but it is not limited to the method. For example, it can also employ a method of extracting the anti-phase component signal S using an adaptive digital filter.

More specifically, assume that the adaptive digital filter employs the right signal R as the input signal and the left signal L as the target signal of the adaptive digital filter (the input signal and the target signal are interchangeable), then it learns filter coefficients adaptively, and uses the error signal between the output signal from the adaptive digital filter and the target signal as the anti-phase component signal S.

Besides, any extracting method of the anti-phase component signal can be employed.

The signal processing section 3, receiving the anti-phase component signal S of the right signal R and left signal L from the anti-phase component extracting section 2, performs digital filter processing on the anti-phase component signal S, thereby carrying out the processing of providing the anti-phase component signal S with the transfer characteristic $(H_d+H_x)/(H_d-H_x)$ which is the transfer characteristic for canceling the crosstalk component.

The adder 4, receiving the in-phase component signal M of the right signal R and left signal L from the in-phase component extracting section 1 and the anti-phase component signal S to which the transfer characteristic $(H_d+H_x)/(H_d-H_x)$ from the signal processing section 3 is provided, adds the phase-inverted signal of the anti-phase component signal S and the in-phase component signal M, and outputs the sum signal of the phase-inverted signal of the anti-phase component signal S and the in-phase component signal M as the driving signal $R_{out}$ of the right speaker.

In other words, the adder 4 generates the driving signal $R_{out}$ of the right speaker by adding the anti-phase component signal S output from the signal processing section 3 in the inverted phase and the in-phase component signal M output from the in-phase component extracting section 1 in the same phase, and outputs it.

The adder 5, receiving the in-phase component signal M of the right signal R and left signal L from the in-phase component extracting section 1 and receiving the anti-phase component signal S to which the transfer characteristic $(H_d+H_x)/(H_d-H_x)$ from the signal processing section 3 is provided, adds the anti-phase component signal S and the in-phase component signal M, and outputs the sum signal of the anti-phase component signal S and the in-phase component signal M as the driving signal $L_{out}$ of the left speaker.

In other words, the adder 5 generates the driving signal $L_{out}$ of the left speaker by adding the anti-phase component signal S output from the signal processing section 3 in the same phase and the in-phase component signal M output from the in-phase component extracting section 1 in the same phase, and outputs it.

The operation of the adders 4 and 5 is applied to the case where the anti-phase component extracting section 2 extracts the anti-phase component signal S by subtracting the right signal R from the left signal L. In contrast, when the anti-phase component extracting section 2 extracts the anti-phase component signal S by subtracting the left signal L from the right signal R, they operate as follows.

More specifically, the adder 4 generates the driving signal $R_{out}$ of the right speaker by adding the anti-phase component signal S output from the signal processing section 3 in the same phase and the in-phase component signal M output from the in-phase component extracting section 1 in the same phase, and outputs it.

On the other hand, the adder 5 generates the driving signal $L_{out}$ of the left speaker by adding the anti-phase component signal S output from the signal processing section 3 in the inverted phase and the in-phase component signal M output from the in-phase component extracting section 1 in the same phase, and outputs it.

The driving signal $R_{out}$ of the right speaker output from the adder 4 of the audio device and the driving signal $L_{out}$ of the left speaker output from the adder 5 can be given by the following expression (1).

[Expression 1]

$$\begin{aligned} R_{out} &= M - S\frac{H_d + H_x}{H_d - H_x} \\ L_{out} &= M + S\frac{H_d + H_x}{H_d - H_x} \\ M &= L + R \\ S &= L - R \end{aligned} \tag{1}$$

When the driving signal $R_{out}$ of the right speaker output from the adder 4 is supplied to the right speaker, and when the driving signal $L_{out}$ of the left speaker output from the adder 5 is supplied to the left speaker, the sounds ER and EL, which are reproduced by the right speaker and left speaker and arrive at the listener's ears, can be given by the following expression (2).

[Expression 2]

$$\begin{aligned} E_R &= R_{out}H_d + L_{out}H_X \\ &= \left(M - S\frac{H_d + H_x}{H_d - H_x}\right)H_d + \left(M + S\frac{H_d + H_x}{H_d - H_x}\right)H_X \\ &= M(H_d + H_X) - S\frac{H_d + H_x}{H_d - H_x}(H_d - H_X) \\ &= M(H_d + H_X) - S(H_d + H_X) \\ &= (M - S)(H_d + H_X) \\ &= 2R(H_d + H_X) \\ E_L &= L_{out}H_d + R_{out}H_X \\ &= \left(M + S\frac{H_d + H_x}{H_d - H_x}\right)H_d + \left(M - S\frac{H_d + H_x}{H_d - H_x}\right)H_X \\ &= M(H_d + H_X) + S\frac{H_d + H_x}{H_d - H_x}(H_d - H_X) \\ &= M(H_d + H_X) + S(H_d + H_X) \\ &= (M + S)(H_d + H_X) \\ &= 2L(H_d + H_X) \end{aligned} \tag{2}$$

It is obvious from the expression (2) that the crosstalk component is completely eliminated from the sounds EL and ER arriving at the listener's right and left ears. However, it is also found that the characteristic $(H_d+H_x)$ is provided.

The characteristic $(H_d+H_x)$, however, is equivalent to the characteristic naturally provided when the sounds are reproduced from ordinary stereo speakers, and hence it does not cause any sound quality deterioration.

As is clear from FIG. 1, since the present embodiment 1 does not perform any processing on the in-phase component signal M output from the in-phase component extracting section 1 and outputs it to the right and left speakers in the same phase without change, the sound quality deterioration of the in-phase component does not occur theoretically.

Accordingly, even if the listener shifts from the standard position, it can offer the good quality center-localized component without providing echoes to the center-localized component.

Figure 3:
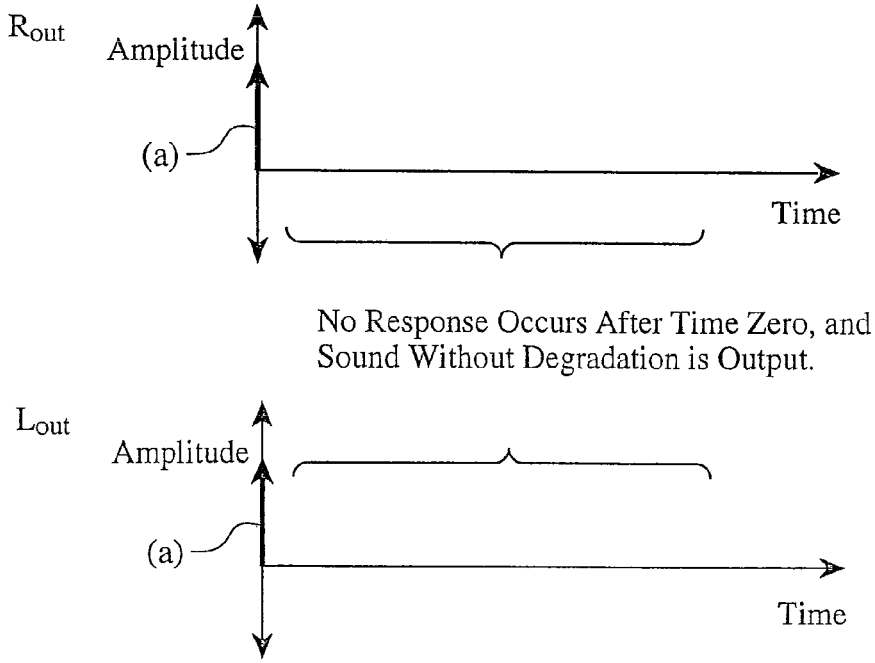
FIG. 3 is a diagram showing time responses of driving signals $R_{out}$ and $L_{out}$ output from the audio device of the embodiment 1.

Here, FIG. 3 is a diagram showing time responses of the driving signals $R_{out}$ and $L_{out}$ output from the audio device of the present embodiment 1.

As is clear from FIG. 3, it is found that the in-phase component does not undergo any processing and is output as it is. In other words, it is found that the frequency characteristics of the in-phase component always become flat, and that the attenuation of the low frequency component does not occur theoretically.

Accordingly, the low frequency component does not thin down, and hence impressive low frequency feeling can be offered.

As is clear from the foregoing description, according to the present embodiment 1, when the transfer characteristic for the sound which is reproduced by a speaker on one side (right speaker, for example) and arrives at the listener's ear on the same side as the speaker on the one side (right ear, for example), is denoted by $H_d$, and the transfer characteristic for the sound which is reproduced by the speaker on the one side and arrives at the listener's ear on the opposite side to the speaker on the one side (left ear, for example), is denoted by $H_x$, the embodiment 1 is configured in such a manner that it has the signal processing section 3 for providing the anti-phase component signal S extracted by the anti-phase component extracting section 2 with the transfer characteristic $(H_d+H_x)/(H_d-H_x)$, and that the adder 4 adds the phase-inverted signal of the anti-phase component signal S provided with the transfer characteristic by the signal processing section 3 and the in-phase component signal M extracted by the in-phase component extracting section 1, and the adder 5 adds the anti-phase component signal S provided with the transfer characteristic by the signal processing section 3 and the in-phase component signal M extracted by the in-phase component extracting section 1. As a result, it offers an advantage of being able to achieve good quality cross-talk cancellation processing without bringing about the sound quality deterioration of the center-localized component or low frequency component.

Although the present embodiment 1 describes the processing for canceling the spatial crosstalk, it is not limited to it. For example, it is applicable to acoustic coupling within a box, which occurs when a plurality of speakers are mounted in the same box.

In this case, it is applicable by using as the transfer characteristic $H_d$ the transfer characteristic caused by the amplifier section/speaker section/box and the like, and as the transfer characteristic $H_x$ the acoustic coupling characteristic by which a speaker is coupled to the speaker on the other side.

Embodiment 2

Figure 4:
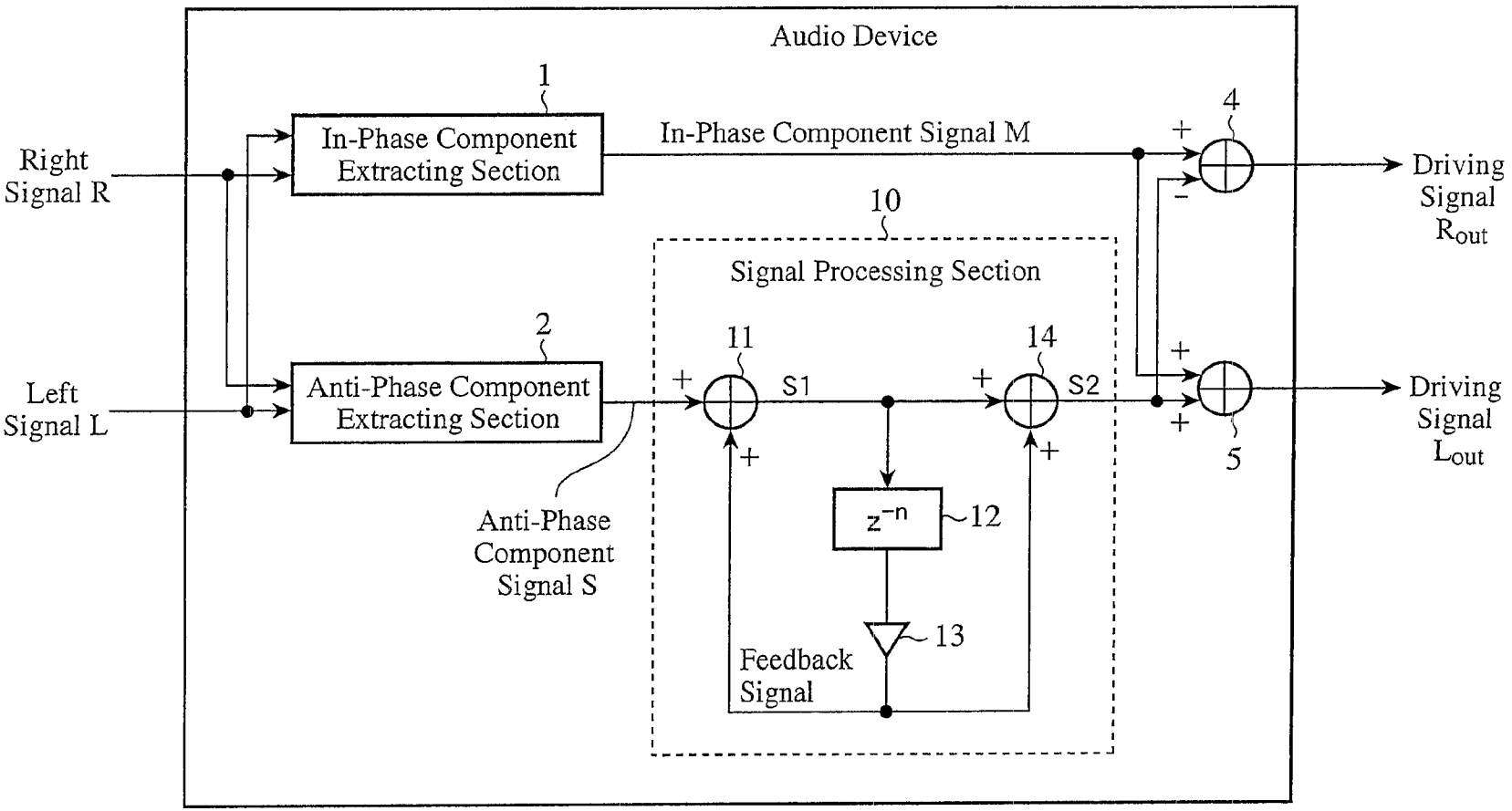
FIG. 4 is a block diagram showing a configuration of an audio device of an embodiment 2 in accordance with the present invention.

FIG. 4 is a block diagram showing a configuration of an audio device of an embodiment 2 in accordance with the present invention. In FIG. 4, since the same reference numerals as those of FIG. 1 designate the same or like portions, their description will be omitted here.

A signal processing section 10 carries out processing of providing the anti-phase component signal S extracted by the anti-phase component extracting section 2 with the transfer characteristic $(H_d+H_x)/(H_d-H_x)$ for canceling the crosstalk component in the same manner as the signal processing section 3 of FIG. 1. Incidentally, the signal processing section 10 constitutes the signal processing means.

An adder 11 of the signal processing section 10 is a first adder that adds the anti-phase component signal S extracted by the anti-phase component extracting section 2 and a feedback signal output from a multiplier 13, and outputs the sum signal S1 of the anti-phase component signal S and the feedback signal.

A delay section 12 carries out the processing of delaying the sum signal S1 output from the adder 11 by n samples.

The multiplier 13 carries out processing of multiplying the sum signal S1 delayed by the delay section 12 by a constant $\alpha$ ($\alpha<1$), and of outputting the multiplication result of the sum signal S1 and the constant $\alpha$ as the feedback signal.

An adder 14 is a second adder that adds the sum signal S1 output from the adder 11 and the feedback signal output from the multiplier 13, and outputs the addition result of the sum signal S1 and the feedback signal to the adders 4 and 5 as the anti-phase component signal $S(H_d+H_x)/(H_d-H_x)$.

Next, the operation will be described.

Since it is the same as the foregoing embodiment 1 except for the signal processing section 10, only the operation of the signal processing section 10 will be described.

The signal processing section 10, receiving the anti-phase component signal S of the right signal R and left signal L from the anti-phase component extracting section 2, carries out processing of providing the anti-phase component signal S with the transfer characteristic $(H_d+H_x)/(H_d-H_x)$ in the same manner as the signal processing section 3 of FIG. 1.

More specifically, the adder 11 of the signal processing section 10, receiving the anti-phase component signal S of the right signal R and left signal L from the anti-phase component extracting section 2, adds the anti-phase component signal S and the feedback signal output from the multiplier 13, and outputs the sum signal S1 of the anti-phase component signal S and the feedback signal to the delay section 12 and adder 14.

The delay section 12, receiving the sum signal S1 from the adder 11, delays the sum signal S1 by the preset n samples, and outputs the delayed sum signal S1 to the multiplier 13.

The multiplier 13, receiving the delayed sum signal S1 from the delay section 12, multiplies the delayed sum signal S1 by a preset number $\alpha$ ($\alpha<1$) to attenuate the signal intensity, and outputs the multiplication result of the sum signal S1 and the constant $\alpha$ to the adders 11 and 14 as the feedback signal.

The adder 14, receiving the sum signal S1 from the adder 11 and the feedback signal from the multiplier 13, adds the sum signal S1 and the feedback signal, and outputs the addition result of the sum signal S1 and the feedback signal to the adders 4 and 5 as the anti-phase component signal $S(H_d+H_x)/(H_d-H_x)$.

In the present embodiment 2, the transfer characteristics $H_d$ and $H_x$ are approximated to simpler functions as shown in the following expression (3) to reduce the operation cost required by the signal processing section 10.

[Expression 3]

$$\begin{aligned} H_d &= 1 \\ H_x &= \alpha \cdot z^{-n}, \\ \alpha &< 1, \\ n &= \frac{\Delta F_s}{c} \end{aligned} \tag{3}$$

where $\Delta$ is the difference between the distance from the speaker on the one side to the ear on the side closer to the speaker and the distance from the speaker on the one side to the ear on the other side of the speaker, $F_s$ is the sampling frequency of the audio signal, and c is the speed of sound.

The approximation shown by expression (3) indicates the behavior of sound waves when disregarding the reproduction environment (walls, floor and furniture of the room) and the diffraction/reflection with the shape of the countenance of the listener.

More specifically, it supposes only the distance attenuation of the amplitude intensity and the delay on the assumption of the transfer characteristics $H_d$ and $H_x$.

In the reproduction environment of the audio device, since the room and the countenance of the listener (oval face/round face, small face/large face, and so on) cannot be determined in general, the approximation shown by expression (3) can also be said to be a robust approximation independently from the room or countenance of the listener at the reproduction.

Here, the output signal S2 of the signal processing section can be expressed by the following expression (4).

[Expression 4]

$$\begin{aligned} S_1 &= S + \alpha z^{-n} S_1 \\ &= \frac{1}{1-\alpha z^{-n}} S \\ S_2 &= S_1 + \alpha z^{-n} S_1 \\ &= S_1(1+\alpha z^{-n}) \\ &= \frac{1}{1-\alpha z^{-n}} S(1+\alpha z^{-n}) \\ &= \frac{1+\alpha z^{-n}}{1-\alpha z^{-n}} S \\ &= \frac{H_d + H_x}{H_d - H_x} S \end{aligned} \tag{4}$$

where $z^{-n}$ denotes the delay of n samples.

As is clear from expression (4), it is found that the signal processing section 10 of the present embodiment 2 can also provide the anti-phase component signal S with the transfer characteristic $(H_d+H_x)/(H_d-H_x)$ in the same manner as the foregoing embodiment 1.

According to the present embodiment 2, since the signal processing section 10 is composed of only two adders 11 and 14, one delay section 12, one multiplier 13, and one feedback path, it offers an advantage of being able to reduce the operation cost very much.

Embodiment 3

Figure 5:
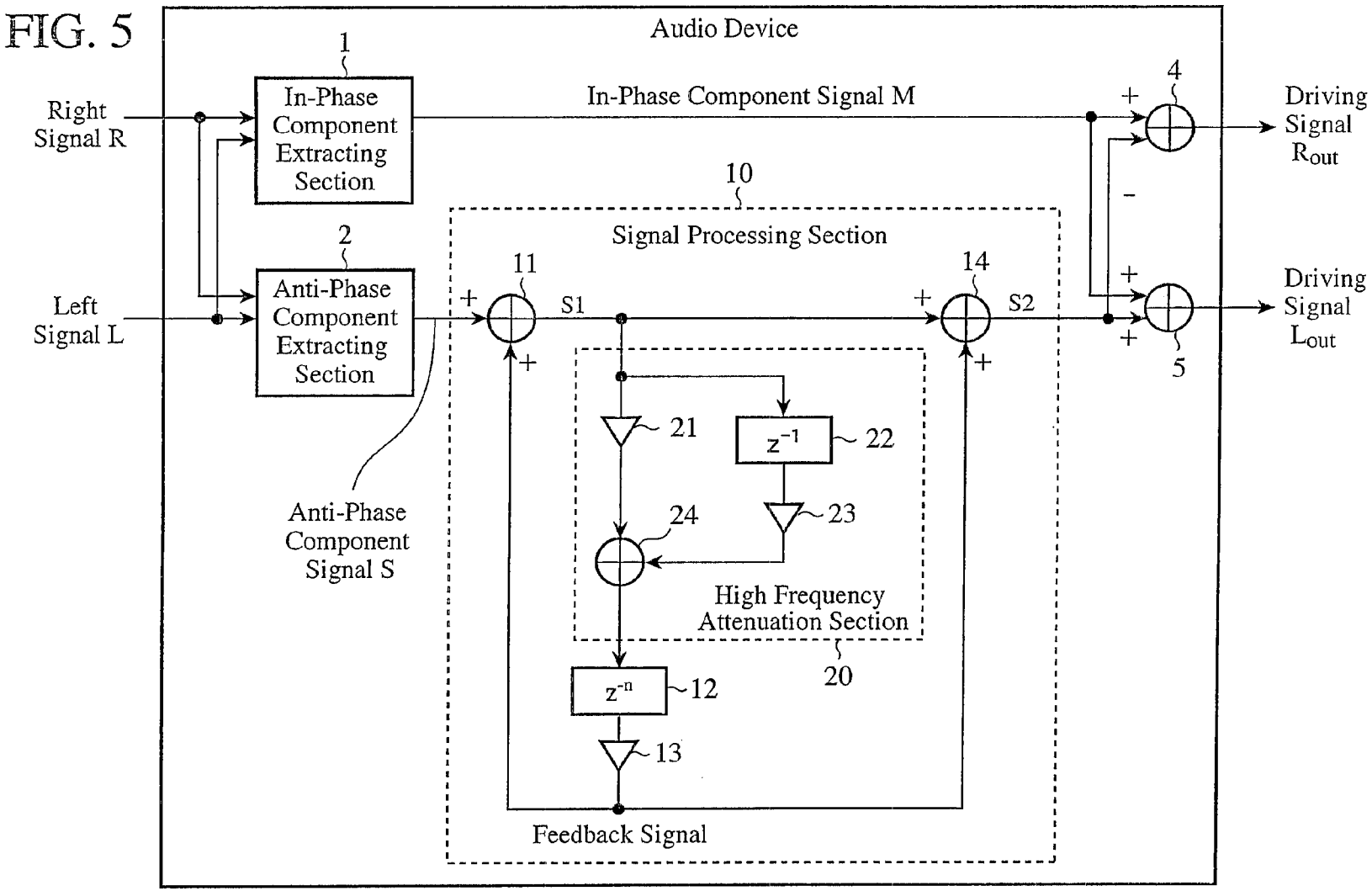
FIG. 5 is a block diagram showing a configuration of an audio device of an embodiment 3 in accordance with the present invention.

FIG. 5 is a block diagram showing a configuration of an audio device of an embodiment 3 in accordance with the present invention. In FIG. 5, since the same reference numerals as those of FIG. 4 designate the same or like portions, their description will be omitted here.

A high frequency attenuation section 20 carries out processing of attenuating a high frequency component contained in the sum signal S1 output from the adder 11.

Although FIG. 5 shows an example that provides the high frequency attenuation section 20 before the delay section 12, the high frequency attenuation section 20 can be provided after the delay section 12.

A multiplier 21 carries out the processing of multiplying the sum signal S1 output from the adder 11 by a prescribed constant $b_0$.

A delay section 22 carries out the processing of delaying the sum signal S1 output from the adder 11 by one sample.

A multiplier 23 carries out the processing of multiplying the sum signal S1 delayed by the delay section 22 by a prescribed constant $b_1$.

An adder 24 carries out the processing of adding the multiplication result of the multiplier 21 and the multiplication result of the multiplier 23.

Next, the operation will be described.

The present embodiment 3 differs from the foregoing embodiment 2 in that the high frequency attenuation section 20 is mounted.

The high frequency attenuation section 20, receiving the sum signal S1 from the adder 11, performs moving average processing on the sum signal S1, thereby carrying out the processing of attenuating the high frequency component contained in the sum signal S1.

The contents of the processing of the high frequency attenuation section 20 will be described concretely below.

The multiplier 21 of the high frequency attenuation section 20, receiving the sum signal S1 from the adder 11, multiplies the sum signal S1 by the prescribed constant $b_0$.

In addition, receiving the sum signal S1 from the adder 11, the delay section 22 delays the sum signal S1 by one sample.

After the delay section 22 delays the sum signal S1 by one sample, the multiplier 23 multiplies the delayed sum signal S1 by the prescribed constant $b_1$.

The adder 24 adds the multiplication result of the multiplier 21 and the multiplication result of the multiplier 23, and outputs the addition result to the delay section 12.

Here, although the device is described in which the high frequency attenuation section 20 attenuates the high frequency component contained in the sum signal S1 by performing second-order moving average processing on the sum signal S1, it is not limited to it. For example, a device is also possible that attenuates the high frequency component by performing higher-order moving average processing. Furthermore, instead of the moving average processing, it is also possible to use, for example, an IIR filter or a low frequency component extracting filter to attenuate the high frequency component.

The present embodiment 3 approximates the transfer characteristics $H_d$ and $H_x$ by simple functions as shown by the following expression (5), thereby being able to achieve the reduction in the operation cost necessary for the signal processing section 10 and to apply more sophisticated transfer characteristics.

[Expression 5]

$$\begin{aligned} H_d &= 1 \\ H_x &= \alpha L z^{-n}, \\ \alpha &< l, \\ n &= \frac{\Delta F_s}{c}, \\ L &= b_0 + b_1 z^{-1} \end{aligned} \tag{5}$$

where L represents the characteristics when the second-order moving average processing is performed, which can be replaced by the characteristics of the higher-order moving average processing. Alternatively, it can be replaced by the frequency characteristics of the IIR filter or of the low frequency component extracting filter.

In contrast to the approximation shown by expression (3) in the foregoing embodiment 2, the approximation shown by expression (5) becomes an approximation in which the diffraction characteristics of the countenance are reflected.

More specifically, the transfer characteristic $H_x$, which has its high frequency component attenuated owing to the diffraction of the countenance, approximates the high frequency attenuation characteristics by L.

Accordingly, it gives a more sophisticated approximation than the foregoing embodiment 2.

Here, the output signal S2 of the signal processing section 10 can be represented by the following expression (6).

[Expression 6]

$$\begin{aligned} S_1 &= S + \alpha L z^{-n} S_1 \\ &= \frac{1}{1-\alpha L z^{-n}} S \\ S_2 &= S_1 + \alpha L z^{-n} S_1 \\ &= S_1(1+\alpha L z^{-n}) \\ &= \frac{1}{1-\alpha L z^{-n}} S(1+\alpha L z^{-n}) \\ &= \frac{1+\alpha L z^{-n}}{1-\alpha L z^{-n}} S \\ &= \frac{H_d + H_x}{H_d - H_x} S \end{aligned} \tag{6}$$

As is clear from expression (6), it is found that the signal processing section 10 in the present embodiment 3 can provide the anti-phase component signal S with the transfer characteristic $(H_d+H_x)/(H_d-H_x)$ in the same manner as the foregoing embodiment 1 or 2.

According to the present embodiment 3, it offers an advantage of being able to achieve the high quality cross-talk cancellation processing considering the diffraction characteristics due to the countenance at a low operation cost about the same level as the foregoing embodiment 2.

Embodiment 4

Figure 6:
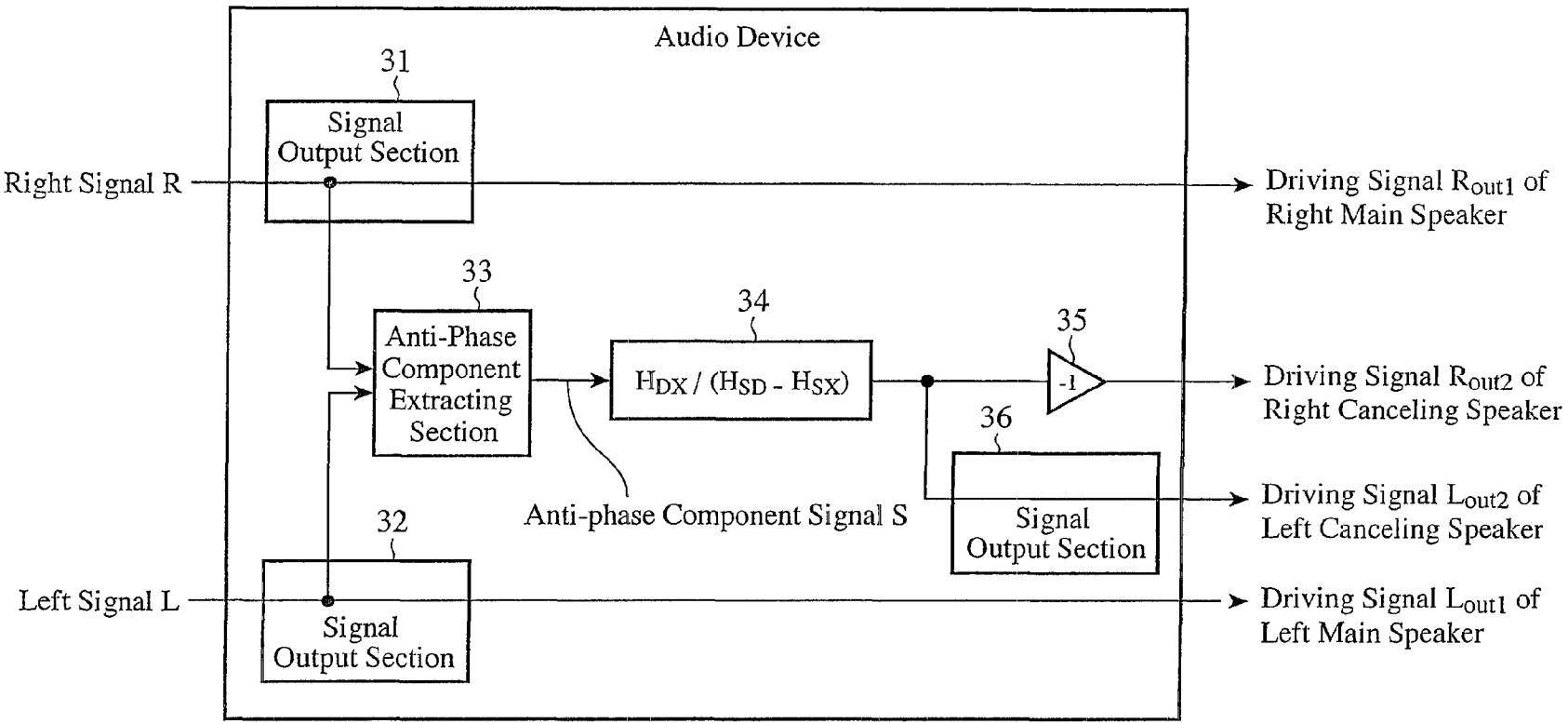
FIG. 6 is a block diagram showing a configuration of an audio device of an embodiment 4 in accordance with the present invention.

FIG. 6 is a block diagram showing a configuration of an audio device of an embodiment 4 in accordance with the present invention. In FIG. 6, a signal output section 31 receives and bifurcates the right signal R of the audio signal, outputs a first right signal R as the driving signal $R_{out1}$ of the right main speaker, and outputs a second right signal R to an anti-phase component extracting section 33. Incidentally, the signal output section 31 constitutes a first signal output means.

A signal output section 32 receives and bifurcates the left signal L of the audio signal, outputs a first left signal L as the driving signal $L_{out1}$ of the left main speaker, and outputs a second left signal L to the anti-phase component extracting section 33. Incidentally, the signal output section 32 constitutes a second signal output means.

As for the right signal R and left signal L of the audio signal input to the signal output sections 31 and 32, although they are preferably binaural signals, they are not limited to them. For example, any audio signals such as a signal output from a CD player or DVD player, a broadcast voice signal received with a DTV receiver, and a signal obtained by A/D converting an analog audio signal can become an object.

The anti-phase component extracting section 33 receives the right signal R and left signal L of the audio signal output from the signal output sections 31 and 32, and carries out the processing of extracting the anti-phase component signal S of the right signal R and left signal L. Incidentally, the anti-phase component extracting section 33 constitutes an anti-phase component extracting means.

A signal processing section 34 carries out the processing of providing the anti-phase component signal S extracted by the anti-phase component extracting section 34 with the transfer characteristic for canceling the crosstalk component. More specifically, when the transfer characteristic for the sound which is reproduced from a main speaker on one side (right main speaker, for example) and arrives at the listener's ear on the other side of the main speaker on the one side (left ear, for example), is $H_{D\ X}$, the transfer characteristic for the sound which is reproduced from the canceling speaker on the one side (right canceling speaker, for example) and arrives at the listener's ear on the same side as the canceling speaker on the one side (right ear, for example), is $H_{S\ D}$, and the transfer characteristic for the sound which is reproduced from the canceling speaker on the one side and arrives at the listener's ear on the other side of the canceling speaker on the one side (left ear, for example), is $H_{S\ X}$, the signal processing section 34 carries out the processing of providing the anti-phase component signal S extracted by the anti-phase component extracting section 34 with the transfer characteristic $H_{D\ X}/(H_{S\ D}-H_{S\ X})$. Incidentally, the signal processing section 34 constitutes a signal processing means.

A phase inverting section 35 inverts the phase of the anti-phase component signal S provided with the transfer characteristic by the signal processing section 34, and carries out the processing of outputting the phase-inverted anti-phase component signal as the driving signal $R_{out2}$ of the right canceling speaker. Incidentally, the phase inverting section 35 constitutes a third signal output means.

A signal output section 36 carries out the processing of outputting the anti-phase component signal S provided with the transfer characteristic by the signal processing section 34 as the driving signal $L_{out2}$ of the left canceling speaker. Incidentally, the signal output section 36 constitutes a fourth signal output means.

Figure 7:
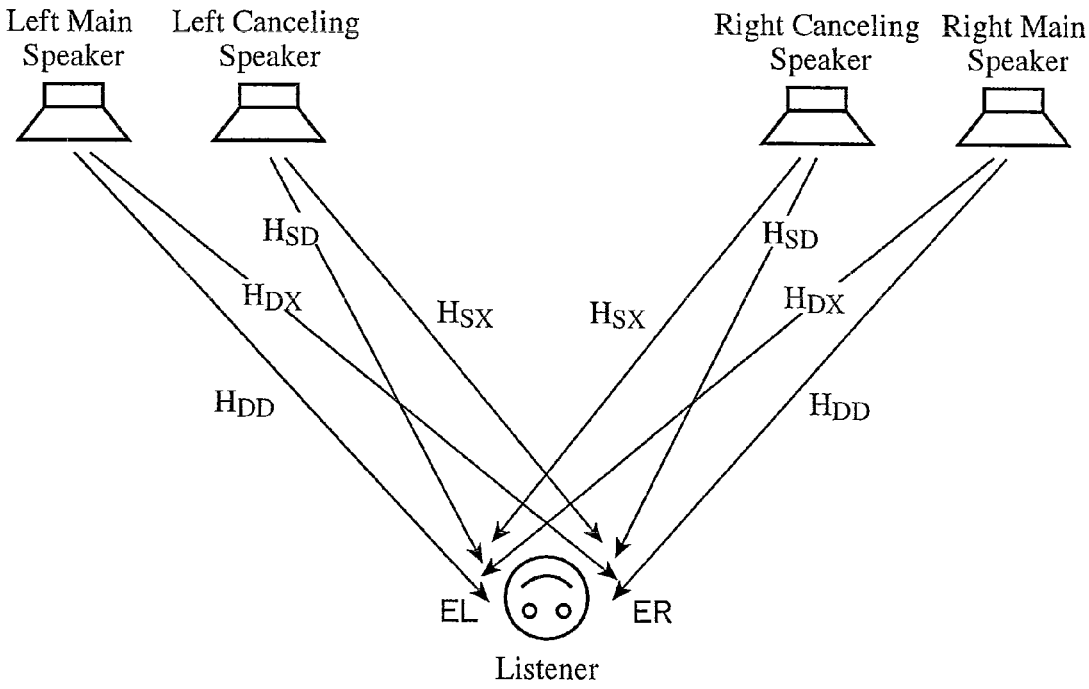
FIG. 7 is a diagram showing relationships among two main speakers at right and left, two cancellation speakers at right and left and the position of the listener and transfer characteristics.

FIG. 7 is a diagram showing relationships among the right and left main speakers, the right and left canceling speakers, the position of the listener and the transfer characteristics.

In FIG. 7, ER designates sounds arriving at the listener's right ear from the right and left speakers, and EL designates sounds arriving at the listener's left ear from the right and left speakers.

Incidentally, $H_{D\ D}$ represents the transfer characteristic for the sound which is reproduced from the main speaker on the one side (right main speaker, for example) and arrives at the listener's ear on the same side as the main speaker on the one side (right ear, for example).

Next, the operation will be described.

The signal output section 31, receiving the right signal R of the audio signal, bifurcates the right signal R, outputs the first right signal R as the driving signal $R_{out1}$ of the right main speaker, and outputs the second right signal R to the anti-phase component extracting section 33.

The signal output section 32, receiving the left signal L of the audio signal, bifurcates the left signal L, outputs the first left signal L as the driving signal $L_{out1}$ of the left main speaker, and outputs the second left signal L to the anti-phase component extracting section 33.

The anti-phase component extracting section 33, receiving the right signal R and left signal L of the audio signal from the signal output sections 31 and 32, extracts the anti-phase component signal S of the right signal R and left signal L in the same manner as the anti-phase component extracting section 2 of FIG. 1.

The signal processing section 34, receiving the anti-phase component signal S of the right signal R and left signal L from the anti-phase component extracting section 33, performs the digital filter processing on the anti-phase component signal S, thereby carrying out the processing of providing the anti-phase component signal S with transfer characteristic for canceling the crosstalk component $H_{DX}/(H_{SD}-H_{SX})$.

The phase inverting section 35, receiving the anti-phase component signal S provided with the transfer characteristic from the signal processing section 34, inverts the phase of the anti-phase component signal S, and outputs the phase-inverted anti-phase component signal S as the driving signal $R_{out2}$ of the right canceling speaker.

The signal output section 36, receiving the anti-phase component signal S provided with the transfer characteristic from the signal processing section 34, outputs the anti-phase component signal S as the driving signal $L_{out2}$ of the left canceling speaker.

Here, the description is made by way of example in which the phase inverting section 35 outputs the phase-inverted anti-phase component signal S as the driving signal $R_{out2}$ of the right canceling speaker and the signal output section 36 outputs the anti-phase component signal S as the driving signal $L_{out2}$ of the left canceling speaker, and in which this operation is applied to the case where the anti-phase component extracting section 33 extracts the anti-phase component signal S by subtracting the right signal R from the left signal L.

In the case where the anti-phase component extracting section 33 extracts the anti-phase component signal S by subtracting the left signal L from the right signal R, the phase inverting section 35 outputs the phase-inverted anti-phase component signal S as the driving signal $L_{out2}$ of the left canceling speaker, and the signal output section 36 outputs the anti-phase component signal S as the driving signal $R_{out2}$ of the right canceling speaker.

As for the driving signal $R_{out1}$ of the right main speaker, the driving signal $L_{out1}$ of the left main speaker, the driving signal $R_{out2}$ of the right canceling speaker, and the driving signal $L_{out2}$ of the left canceling speaker, which are output from the audio device, they can be given by the following expression (7).

[Expression 7]

$$\begin{aligned} R_{out1} &= R \\ L_{out1} &= L \\ R_{out2} &= -S\frac{H_{DX}}{H_{SD}-H_{SX}} \\ &= -(L-R)\frac{H_{DX}}{H_{SD}-H_{SX}} \\ L_{out2} &= S\frac{H_{DX}}{H_{SD}-H_{SX}} \\ &= (L-R)\frac{H_{DX}}{H_{SD}-H_{SX}} \end{aligned} \tag{7}$$

When the driving signal $R_{out1}$ of the right main speaker output from the audio device is output to the right main speaker, the driving signal $L_{out1}$ of the left main speaker is output to the left main speaker, the driving signal $R_{out2}$ of the right canceling speaker is output to the right canceling speaker, and the driving signal $L_{out2}$ of the left canceling speaker is output to the left canceling speaker, the sounds ER and EL which arrive at the ears of the listener after reproduced from the right and left main speakers and from the right and left canceling speakers are given by the following expression (8).

[Expression 8]

$$\begin{aligned} E_R &= R_{out1}H_{DD} + R_{out2}H_{SD} + L_{out1}H_{DX} + L_{out2}H_{SX} \\ &= RH_{DD} - (L-R)\frac{H_{DX}}{H_{SD}-H_{SX}}H_{SD} + LH_{DX} + \\ &\quad (L-R)\frac{H_{DX}}{H_{SD}-H_{SX}} - H_{SX} \\ &= RH_{DD} + R\frac{H_{DX}}{H_{SD}-H_{SX}}H_{SD} - R\frac{H_{DX}}{H_{SD}-H_{SX}}H_{SX} - \\ &\quad L\frac{H_{DX}}{H_{SD}-H_{SX}}H_{SD} + LH_{DX} + L\frac{H_{DX}}{H_{SD}-H_{SX}}H_{SX} \\ &= R\left(H_{DD} + \frac{H_{DX}H_{SD}}{H_{SD}-H_{SX}} - \frac{H_{DX}H_{SX}}{H_{SD}-H_{SX}}\right) + \\ &\quad L\left(H_{DX} - \frac{H_{DX}H_{SD}}{H_{SD}-H_{SX}} + \frac{H_{DX}H_{SX}}{H_{SD}-H_{SX}}\right) \\ &= R\left(\frac{H_{DD}(H_{SD}-H_{SX}) + H_{DX}H_{SD} - H_{DX}H_{SX}}{H_{SD}-H_{SX}}\right) + \\ &\quad L\left(\frac{H_{DX}(H_{SD}-H_{SX}) - H_{DX}H_{SD} + H_{DX}H_{SX}}{H_{SD}-H_{SX}}\right) \\ &= R\left(\frac{(H_{DD}+H_{DX})(H_{SD}-H_{SX})}{H_{SD}-H_{SX}}\right) + L\left(\frac{0}{H_{SD}-H_{SX}}\right) \\ &= R(H_{DD}+H_{DX}) \\ E_L &= L_{out1}H_{DD} + L_{out2}H_{SD} + R_{out1}H_{DX} + R_{out2}H_{SX} \\ &= LH_{DD} + (L-R)\frac{H_{DX}}{H_{SD}-H_{SX}}H_{SD} + RH_{DX} - \\ &\quad (L-R)\frac{H_{DX}}{H_{SD}-H_{SX}}H_{SX} \\ &= LH_{DD} + L\frac{H_{DX}}{H_{SD}-H_{SX}}H_{SD} - L\frac{H_{DX}}{H_{SD}-H_{SX}}H_{SX} + \\ &\quad RH_{DX} - R\frac{H_{DX}}{H_{SD}-H_{SX}}H_{SD} + R\frac{H_{DX}}{H_{SD}-H_{SX}}H_{SX} \\ &= L\left(H_{DD} + \frac{H_{DX}H_{SD}}{H_{SD}-H_{SX}} - \frac{H_{DX}H_{SX}}{H_{SD}-H_{SX}}\right) + \\ &\quad R\left(H_{DX} - \frac{H_{DX}H_{SD}}{H_{SD}-H_{SX}} + \frac{H_{DX}H_{SX}}{H_{SD}-H_{SX}}\right) \\ &= L\left(\frac{H_{DD}(H_{SD}-H_{SX}) + H_{DX}H_{SD} - H_{DX}H_{SX}}{H_{SD}-H_{SX}}\right) + \\ &\quad R\left(\frac{H_{DX}(H_{SD}-H_{SX}) - H_{DX}H_{SD} + H_{DX}H_{SX}}{H_{SD}-H_{SX}}\right) \\ &= L\left(\frac{(H_{DD}+H_{DX})(H_{SD}-H_{SX})}{H_{SD}-H_{SX}}\right) + R\left(\frac{0}{H_{SD}-H_{SX}}\right) \\ &= L(H_{DD}+H_{DX}) \end{aligned} \tag{8}$$

As is clear from expression (8), it is found that the sounds EL and ER arriving at the listener's right and left ears have their crosstalk components eliminated completely. It is also found, however, that the characteristic $(H_{DD}+H_{DX})$ is provided.

The characteristic $(H_{DD}+H_{DX})$, however, is equivalent to the characteristic naturally provided when the sounds are reproduced from the main speaker, and hence it does not bring about the sound quality deterioration.

In the present embodiment 4, as is clear from FIG. 6, since the right signal R and left signal L without undergoing any processing by the speaker system are reproduced by the main speakers, the deterioration in the sound quality of the in-phase signal without any anti-phase component does not occur theoretically.

Accordingly, even if the listener shifts from the standard position, it can offer the good quality center-localized component without adding echoes to the center-localized component.

In addition, it is found that the frequency characteristics of the in-phase component always become flat, and that the attenuation of the low frequency component does not occur theoretically.

Accordingly, the low frequency component does not thin down, and hence it offers an advantage of being able to provide an impressive low frequency feeling.

Embodiment 5

Figure 8:
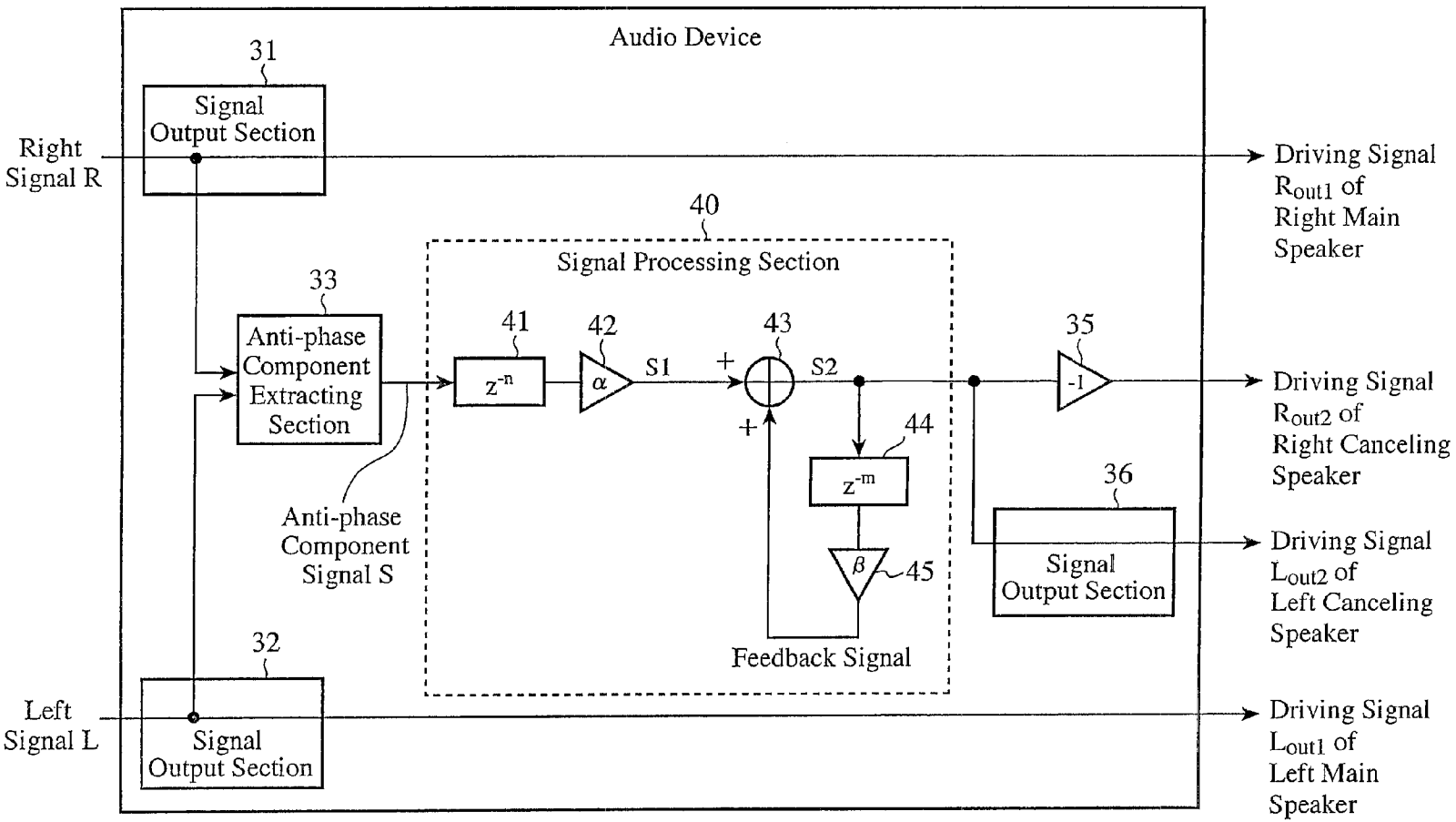
FIG. 8 is a block diagram showing a configuration of an audio device of an embodiment 5 in accordance with the present invention.
Figure 9:
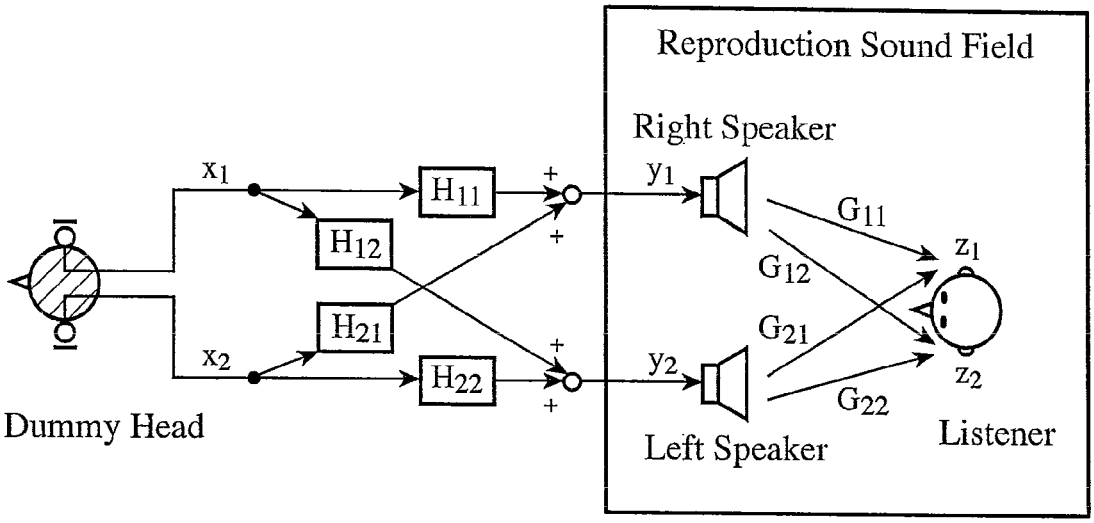
FIG. 9 is a block diagram showing a configuration of a system disclosed in Non-Patent Document 1.
Figure 10:
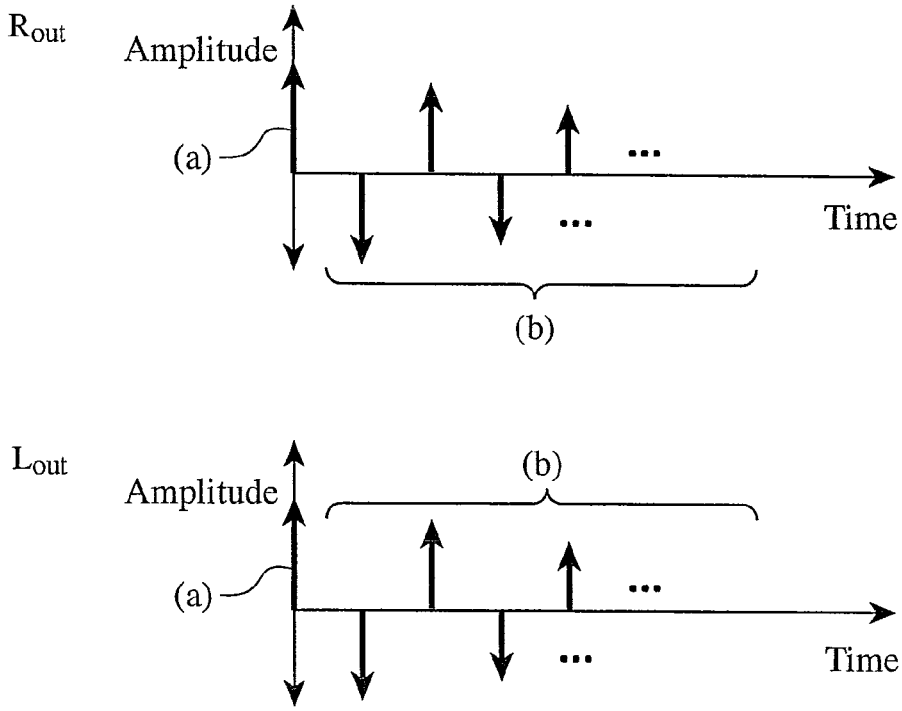
FIG. 10 is a diagram showing time responses of signals output from the audio device when in-phase component signals are input to cross-talk cancellation processing.
Figure 11:
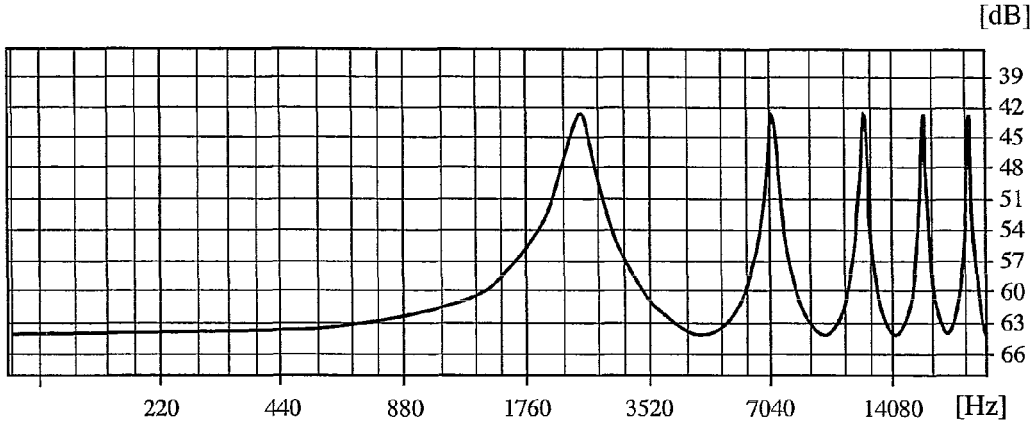
FIG. 11 is a diagram showing a result of frequency analysis of FIG. 10.

FIG. 8 is a block diagram showing a configuration of an audio device of an embodiment 5 in accordance with the present invention. In FIG. 8, since the same reference numerals as those of FIG. 6 designate the same or like portions, their description will be omitted here.

A signal processing section 40 carries out the processing of providing the anti-phase component signal S extracted by the anti-phase component extracting section 33 with the transfer characteristic $H_{DX}/(H_{SD}-H_{SX})$ in the same manner as the signal processing section 34 of FIG. 6. Incidentally, the signal processing section 40 constitutes the signal processing means.

A delay section 41 (first delay section) of the signal processing section 40 carries out the processing of delaying the anti-phase component signal S extracted by the anti-phase component extracting section 33 by n samples.

A multiplier 42 (first multiplier) carries out the processing of multiplying the anti-phase component signal S delayed by the delay section 41 by a constant α (α<1).

An adder 43 adds the anti-phase component signal S multiplied by the constant α with the multiplier 42 and the feedback signal output from a multiplier 45, and carries out the processing of outputting the sum signal of the anti-phase-component signal S and the feedback signal to a delay section 44, and of outputting the sum signal to the phase inverting section 35 and signal output section 36 as the anti-phase component signal $S\cdot H_{DX}/(H_{SD}-H_{SX})$.

The delay section 44 (second delay section) carries out the processing of delaying the sum signal output from the adder 43 by m samples.

The multiplier 45 (second multiplier) multiplies the sum signal delayed by the delay section 44 by a constant β (β<1), and carries out the processing of outputting the multiplication result of the sum signal and the constant β to the adder 43 as the feedback signal.

Next, the operation will be described.

Except for the signal processing section 40, since it is the same as the foregoing embodiment 4, only the operation of the signal processing section 40 will be described.

In the same manner as the signal processing section 34 of FIG. 6, the signal processing section 40, receiving the anti-phase component signal S of the right signal R and left signal L from the anti-phase component extracting section 33, carries out the processing of providing the anti-phase component signal S with the transfer characteristic $H_{DX}/(H_{SD}-H_{SX})$.

More specifically, the delay section 41 of the signal processing section 40, receiving the anti-phase component signal S from the anti-phase component extracting section 33, delays the anti-phase component signal S by preset n samples, and outputs the delayed anti-phase component signal S to the multiplier 42.

Receiving the delayed anti-phase component signal S from the delay section 41, the multiplier 42 multiplies the delayed anti-phase component signal S by the preset constant α (α<1) to attenuate the signal intensity, and outputs the multiplication signal S1 of the delayed anti-phase component signal S and the constant α to the adder 43.

Receiving the multiplication signal S1 from the multiplier 42 and the feedback signal from the multiplier 45, the adder 43 adds the multiplication signal S1 and the feedback signal, outputs the sum signal S2 of the multiplication signal S1 and the feedback signal to the delay section 44, and outputs the sum signal S2 to the phase inverting section 35 and signal output section 36 as the anti-phase component signal $S\cdot H_{DX}/(H_{SD}-H_{SX})$.

Receiving the sum signal S2 from the adder 43, the delay section 44 delays the sum signal S2 by the preset m samples, and outputs the delayed sum signal S2 to the multiplier 45.

Receiving the delayed sum signal S2 from the delay section 44, the multiplier 45 multiplies the delayed sum signal S2 by the preset constant β (β<1) to attenuate the signal intensity, and outputs the multiplication result of the sum signal S2 and the constant β to the adder 43 as the feedback signal.

The present embodiment 5 reduces the operation cost necessary for the signal processing section 40 by approximating the transfer characteristics $H_{DX}$, $H_{SD}$ and $H_{SX}$ by simple functions as shown in the following expression (9).

[Expression 9]

$$\begin{aligned} H_{SD} &= 1 \\ H_{DX} &= \alpha\cdot z^{-n}, \\ \alpha &< 1, \\ n &= \frac{\Delta_1 F_s}{c} \\ H_{SX} &= \beta\cdot z^{-m}, \\ \alpha &< 1, \\ m &= \frac{\Delta_2 F_2}{c} \end{aligned} \tag{9}$$

where Δ1 is the difference between the distance from the canceling speaker (right canceling speaker, for example) to the ear on the side closer to the canceling speaker (right ear, for example) and the distance from the main speaker (right main speaker, for example) to the ear on the other side of the main speaker (left ear, for example), and Δ2 is the difference between the distance from the canceling speaker (right canceling speaker, for example) to the ear on the side closer to the canceling speaker (right ear, for example) and the distance from the canceling speaker to the ear on the other side of the canceling speaker (left ear, for example).

In addition, $F_s$ denotes the sampling frequency of the audio signal, and c represents the speed of sound.

The approximation shown by expression (9) indicates the behavior of sound waves when disregarding the reproduction environment (walls, floor and furniture of the room) and the diffraction/reflection with the shape of the countenance of the listener just as the approximation shown by expression (3).

Here, the output signal S2 of the signal processing section 40 can be expressed by the following expression (10).

[Expression 10]

$$\begin{aligned} S_1 &= \alpha z^{-n} S \\ S_2 &= S_1 + \beta z^{-m} S_2 \\ &= \frac{1}{1-\beta z^{-m}} S_1 \\ &= \frac{\alpha z^{-n}}{1-\beta z^{-m}} S \\ &= \frac{H_{DX}}{H_{SD}-H_{SX}} S \end{aligned} \tag{10}$$

where $z^{-n}$ denotes the delay of n samples, and $z^{-m}$ denotes the delay of m samples.

As is clear from expression (10), it is found that the signal processing section 40 of the present embodiment 5 can also provide the anti-phase component signal S with the transfer characteristic $H_{D\,X}/(H_{S\,D}-H_{S\,X})$ in the same manner as the foregoing embodiment 4.

According to the present embodiment 5, since the signal processing section 40 is composed of only one adder 43, two delay sections 41 and 44, two multipliers 42 and 45, and one feedback path, it offers an advantage of being able to reduce the operation cost very much.

INDUSTRIAL APPLICABILITY

As described above, the present invention is suitable for an audio device that achieves good quality cross-talk cancellation processing without involving the sound quality deterioration of the center-localized component or low frequency component.

What is claimed is:

1. An audio device comprising:

in-phase component extracting means for receiving a right signal and left signal of an audio signal, and for extracting an in-phase component signal of the right signal and left signal;

anti-phase component extracting means for receiving the right signal and left signal of the audio signal, and for extracting an anti-phase component signal of the right signal and left signal;

signal processing means for providing the anti-phase component signal extracted by the anti-phase component extracting means with a transfer characteristic for canceling a crosstalk component;

first adding means for adding a phase-inverted signal of the anti-phase component signal provided with the transfer characteristic by the signal processing means and the in-phase component signal extracted by the in-phase component extracting means; and second adding means for adding the anti-phase component signal provided with the transfer characteristic by the signal processing means and the in-phase component signal extracted by the in-phase component extracting means.

2. The audio device according to claim 1, wherein when a transfer characteristic of sound which is reproduced from a speaker on one side of stereo speakers and arrives at a listener's ear on the same side of the speaker, is represented by $H_d$, and a transfer characteristic for the sound which is reproduced from the speaker on the one side and arrives at a listener's ear on the other side of the speaker, is represented by $H_x$, the signal processing means provides the anti-phase component signal extracted by the anti-phase component extracting means with a transfer characteristic obtained by dividing the sum of the transfer characteristic $H_d$ and the transfer characteristic $H_x$ by the difference between the transfer characteristic $H_d$ and the transfer characteristic $H_x$ as a transfer characteristic for canceling a crosstalk component.

3. The audio device according to claim 2, wherein the signal processing means comprises:

a first adder for adding the anti-phase component signal extracted by the anti-phase component extracting means and a feedback signal, and for outputting a sum signal of the anti-phase component signal and the feedback signal;

a delay section for delaying the sum signal output from the first adder by a length of prescribed samples;

a multiplier for multiplying the sum signal delayed by the delay section by a constant, and for outputting a multiplication result of the sum signal and the constant as the feedback signal; and a second adder for adding the sum signal output from the first adder and the feedback signal output from the multiplier, and for outputting a sum signal of the sum signal and the feedback signal to the first and second adding means.

4. The audio device according to claim 3, further comprising a high frequency attenuation section for attenuating a high frequency component contained in the sum signal, which is placed at a stage before or after the delay section.

5. The audio device according to claim 4, wherein the high frequency attenuation section attenuates the high frequency component contained in the sum signal by performing moving average processing on the sum signal.

6. An audio device comprising:

first signal output means for receiving a right signal of an audio signal, and for outputting the right signal as a driving signal of a right main speaker;

second signal output means for receiving a left signal of the audio signal, and for outputting the left signal as a driving signal of a left main speaker;

anti-phase component extracting means for receiving the right signal and left signal of the audio signal, and for extracting an anti-phase component signal of the right signal and left signal;

signal processing means for providing the anti-phase component signal extracted by the anti-phase component extracting means with a transfer characteristic for canceling a crosstalk component;

third signal output means for inverting a phase of the anti-phase component signal provided with the transfer characteristic by the signal processing means, and for outputting the phase-inverted anti-phase component signal as a driving signal of a first canceling speaker; and fourth signal output means for outputting the anti-phase component signal provided with the transfer characteristic by the signal processing means as a driving signal of a second canceling speaker.

7. The audio device according to claim 6, wherein when a transfer characteristic of sound which is reproduced from a main speaker on one side of stereo speakers and arrives at a listener's ear on the other side of the main speaker, is represented by $H_{D\,X}$, a transfer characteristic of sound which is reproduced from a canceling speaker on one side and arrives at a listener's ear on the same side as the canceling speaker, is represented by $H_{S\,D}$, and a transfer characteristic of the sound which is reproduced from the canceling speaker on one side and arrives at a listener's ear on the other side of the canceling speaker, is represented by $H_{S\,X}$, the signal processing means provides the anti-phase component signal extracted by the anti-phase component extracting means with a transfer characteristic obtained by dividing the transfer characteristic $H_{DX}$ by the difference between the transfer characteristic $H_{S\,D}$ and the transfer characteristic $H_{S\,X}$ as a transfer characteristic for canceling the crosstalk component.

8. The audio device according to claim 7, wherein the signal processing means comprises:

a first delay section for delaying the anti-phase component signal extracted by the anti-phase component extracting means by a length of prescribed samples;

a first multiplier for multiplying the anti-phase component signal delayed by the first delay section by a constant;

an adder for adding the anti-phase component signal multiplied by the constant with the first multiplier and a feedback signal, and for outputting the sum signal of the anti-phase component signal and the feedback signal to the third and fourth signal output means;

a second delay section for delaying the sum signal output from the adder by a length of prescribed samples; and a second multiplier for multiplying the sum signal delayed by the second delay section by a constant, and for outputting a multiplication result of the sum signal and the constant to the adder as the feedback signal.

* * * * *